US007856767B2

(12) United States Patent
Janesky

(10) Patent No.: US 7,856,767 B2
(45) Date of Patent: Dec. 28, 2010

(54) CRAWLSPACE ENCAPSULATION AND DRAINAGE SYSTEM

(76) Inventor: Lawrence M. Janesky, 60 Silvermine Rd., Seymour, CT (US) 06483

( * ) Notice: Subject to any disclaimer, the term of this patent is extended or adjusted under 35 U.S.C. 154(b) by 817 days.

(21) Appl. No.: 10/798,215

(22) Filed: Mar. 11, 2004

(65) Prior Publication Data

US 2005/0210772 A1 Sep. 29, 2005

(51) Int. Cl.
*E02D 19/00* (2006.01)

(52) U.S. Cl. ..... 52/169.14; 52/169.5; 405/270; 405/229

(58) Field of Classification Search ..... 52/302.1, 52/302.3, 169.5, 169.14, 93.2, 741.1, 746.1; 405/229, 270, 45

See application file for complete search history.

(56) References Cited

U.S. PATENT DOCUMENTS

| | | | | |
|---|---|---|---|---|
| 4,320,604 | A | 3/1982 | O'Hanlon | |
| 4,760,674 | A * | 8/1988 | Brand et al. | 52/302.3 |
| 4,843,786 | A * | 7/1989 | Walkinshaw et al. | 52/169.5 |
| 4,907,386 | A * | 3/1990 | Ekroth | 52/169.14 |
| 4,943,185 | A | 7/1990 | McGuckin et al. | |
| 4,945,697 | A * | 8/1990 | Ott et al. | 52/403.1 |
| 5,107,642 | A * | 4/1992 | Mogstad | 52/169.5 |
| 5,184,437 | A * | 2/1993 | Woong et al. | 52/169.5 |
| 5,642,967 | A * | 7/1997 | Swain et al. | 405/229 |
| 5,660,018 | A * | 8/1997 | Brodsky | 52/741.4 |
| 5,666,772 | A * | 9/1997 | Betty | 52/177 |
| 5,775,039 | A | 7/1998 | McPherson | |
| 5,836,815 | A * | 11/1998 | Jennemann | 454/341 |
| 5,931,603 | A * | 8/1999 | Swain et al. | 405/229 |
| 6,082,932 | A * | 7/2000 | Anderson | 405/229 |
| 6,101,775 | A * | 8/2000 | Larimore | 52/302.1 |
| 6,279,279 | B1 * | 8/2001 | Larimore | 52/302.1 |
| 6,477,811 | B1 * | 11/2002 | Choi | 52/169.5 |
| 6,575,666 | B1 | 6/2003 | Janesky | |
| 6,634,144 | B1 * | 10/2003 | Moore et al. | 52/169.5 |
| 6,672,016 | B2 | 1/2004 | Janesky | |
| 6,904,723 | B1 * | 6/2005 | Moore et al. | 52/169.5 |
| 6,926,469 | B2 * | 8/2005 | Janesky | 405/270 |
| 2002/0139074 | A1 * | 10/2002 | Smith | 52/302.1 |
| 2003/0154676 | A1 * | 8/2003 | Schwartz | 52/391 |

OTHER PUBLICATIONS

John Carmody, Jeffrey Christian, Kenneth Labs, Builder's Foundation Handbook, Published May 1991, pp. 38-54.*

Joseph Lstiburek, John Carmody, Moisture Control Handbook New, Low-Rise, Residential Construction, Published Oct. 1991, pp. 143-167.*

Craig DeWitt, PhD, PE, RLC Engineering, LLC Sealed Crawl Space Specifications, Published Aug. 20, 2001.*

* cited by examiner

*Primary Examiner*—Richard E Chilcot, Jr.
*Assistant Examiner*—Beth Stephan
(74) *Attorney, Agent, or Firm*—Perman & Green, LLP

(57) ABSTRACT

A novel simplified system for protecting a crawlspace against the entry of sub-soil water vapor and external ground water from the crawlspace walls and floor and for completely isolating the crawlspace from water vapor from the ground. The present system comprises applying over the floor of the crawlspace, generally a dirt floor but sometimes a poured concrete floor, a continuous durable embossed plastic drainage panel, and extending the drainage panel vertically-upwardly to cover and seal the interior peripheral foundation walls enclosing the crawlspace to an elevation at least slightly greater than the elevation of the ground in contact with the exterior surfaces of the peripheral walls and preferably to the tops of the peripheral walls. This encapsulates the dirt surface of the entire crawlspace against the penetration of external ground water or floor water and also sub-soil water and water vapor and provides a water drainage space beneath the drainage panel for the escape of water and vapor therefrom.

14 Claims, 3 Drawing Sheets

CRAWLSPACE ENCAPSULATION AND DRAINAGE SYSTEM

BACKGROUND OF THE INVENTION

1. Field of the Invention

The present invention relates to a novel and efficient system for preventing the entry of ground moisture into so-called crawlspaces of buildings such as homes, and for permitting the free drainage of groundwater from the floor thereof, whether dirt or concrete. Moisture is very damaging to wood structural support members of buildings and is absorbed by such members from the ground and from moist air in contact therewith.

As disclosed in my U.S. Pat. No. 6,575,661, issued Jun. 10, 2003, the disclosure of which is hereby incorporated herein, many buildings and homes are built without basements, and are elevated a few feet above the ground on support members such as stone, poured concrete or concrete block walls. In many cases the crawlspace between the ground surface and the wooden floor beams or joists of the house is at a level below the level of the surrounding soil, or below the level of saturated soils in wet weather, so that water flows into and is absorbed up through the floor of the crawlspace, usually a dirt surface, from adjacent ground areas of higher elevation and up from the sub-soil. Such water is drawn into the headroom of the crawl space in the form of water vapor and penetrates the wooden structural members of the building, causing wood rot, mold, odors, attraction of ants and other insects, rodents etc. Also, the escape of dangerous radon gas from the ground into the crawlspace and into the building is another problem.

Even in crawlspaces that do not leak or flood from groundwater, the earth below the crawlspace, and forming the floor of the crawlspace, has a high humidity level most of the time, and this water vapor rises into the crawlspace to produce a humid air atmosphere within the crawlspace, which moves upwardly to penetrate the structural framing and living spaces above the crawlspace.

Mold spores exist in air and grow into destructive mold in the presence of organic material, such as moist wood. Humidity levels of from 50% to 90% are common in crawlspaces, even those that have never flooded. Mold can grow on dirt, insulation, wood framing and even under carpeting on the floor within the home. Mold digests and destroys organic materials as it feeds on them. Damp environments also provide an inviting environment for insects such as termites, ants and other insects which feed on moist organic material such as structural support wood and can contribute to the destruction and collapse thereof.

2. State of the Art

In an effort to prevent the penetration of water and water vapor into building crawlspaces it has been proposed to apply a continuous moisture barrier layer such as a 6 mil thick plastic film over the dirt floor of the crawlspace. This has been proven to be unsatisfactory, per se, since water is drawn up from the ground, beneath the barrier, and leaks and/or vaporizes around the edges of the barrier into the crawlspace environment. Also, ground water penetrates the walls of the crawlspace and/or otherwise enters the crawlspace and accumulates on top of the vapor barrier film and generates moisture which permeates into the wooden structural supports of the building resulting in rot and decay, mold and fungus, odors and vermin. Also a 6 mil vapor barrier film is not sufficiently durable to resist tearing and being punctured under the stress and weight of a workman crawling on it.

U.S. Pat. No. 5,642,967 discloses a system in which the barrier film is associated with an excavated pit filled with aggregate.

Water entering the crawlspace collects in the pit and is pumped from a sump when necessary. A vapor barrier film is applied over the dirt floor of the crawlspace, and over the pit and sump areas, to prevent moisture from entering the building. Such a system is unsatisfactory because it has no means for preventing the entry of ground water and its accumulation on the surface of the barrier film, with the disadvantages discussed supra.

U.S. Pat. No. 5,890,845 discloses another system in which the dirt floor of a crawlspace is covered with a layer of lightweight concrete material applied over a plastic film barrier layer. While the barrier layer blocks the penetration of moisture from the ground up into the crawlspace, the system provides no means for preventing the entry of ground water through the walls of the crawlspace onto the surface of the concrete material where it can accumulate in surface depressions and develop moisture, with the disadvantages discussed supra.

My aforementioned U.S. Pat. No. 6,575,666 discloses a system which prevents the entry of water from the sub-soil and also from higher elevations of the surrounding ground, such as excessive ground water caused by rain, snow and/or flooding, into crawlspaces directly or through concrete block walls which surround and enclose the crawlspace. The system of U.S. Pat. No. 6,575,666 comprises applying over the floor of the crawlspace, generally a dirt floor but sometimes a poured concrete floor, a continuous sealed plastic film barrier layer, and extending the barrier film vertically-upwardly to cover and seal the interior peripheral walls enclosing the crawlspace to an elevation at least slightly greater than the elevation of the ground in contact with the exterior surfaces of the peripheral walls and preferably to the tops of the peripheral walls. This encapsulates the dirt surface of the entire crawlspace against the penetration of external ground water or flood water and also sub-soil water and water vapor onto the surface of the plastic barrier film and into the crawlspace atmosphere.

According to an embodiment of U.S. Pat. No. 6,575,666, the dirt surface of the crawlspace may be first provided with a sump pit and/or a drainage trench system for the collection of sub-soil water that leaks in from the crawlspace floor or walls under the barrier layer. A perimeter drain conduit or sump pump may be associated with the sump pit or drainage trench, depending upon the degree of wetness of the crawlspace and the grade and elevation of the exterior ground surrounding the floor of the crawlspace, to discharge excessive amounts of water accumulated beneath the barrier layer to areas exterior to the crawl space.

In situations involving a pre-existing crawlspace having a dirt floor or a concrete floor with a water leakage problem and no peripheral water drainage system or drainage trench, it is generally not possible, because of the head space limitations, to dig a suitable perimeter drainage trench in a dirt floor, or to jackhammer a suitable peripheral trench or sump pit, through a concrete floor, and to install a heavy drainage stone bed under the vapor barrier liner to enable water drainage from beneath the liner. In such situations there is a need for a compact, lightweight alternative system which is easy to install over the dirt or concrete floor of a crawlspace, in place of or beneath a durable vapor barrier liner, to enable and facilitate the drainage of water from, the surface of the dirt or concrete floor to a low spot such as a sump pit.

While the system of U.S. Pat. No. 6,575,666 represents a substantial improvement in the waterproofing of crawlspaces, there remains a need for an improved system which avoids the trapping and pudding of ground water beneath the barrier layer, especially over a concrete floor of the crawlspace, and which further insulates the barrier layer against rough concrete surfaces rupturing or tearing the membrane under the weight of workmen crawling thereover during installation or at other times.

SUMMARY OF THE INVENTION

The present invention relates to a crawlspace waterproofing system which is an improvement over the system of my U.S. Pat. No. 6,575,666 and is characterized by installing a durable, flexible, embossed plastic drainage panel over the crawlspace floor, especially a concrete floor, and/or wall and under an optional barrier layer, in order to facilitate the drainage of ground water from beneath the drainage panel to a drain and prevent the accumulation and pudding of ground water on the ground beneath the drainage panel within the crawlspace environment.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENT

Figure 1:
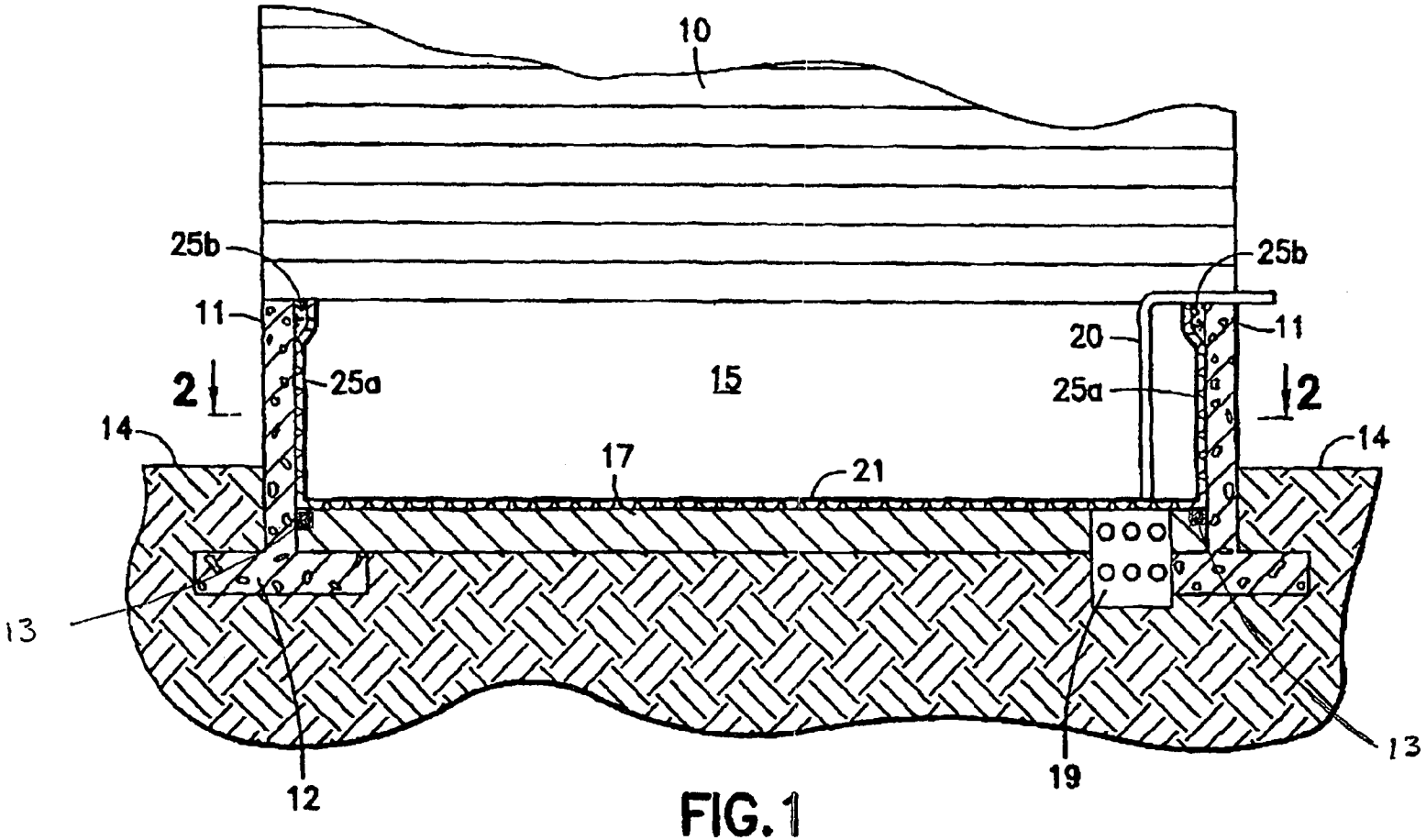
FIG. 1 is a side elevational view of a building having a crawlspace encapsulated according to one embodiment of the present invention, shown partially in cross-section.

Referring to the drawings, a building 10 (FIG. 1) such as a house is illustrated supported upon peripheral foundation walls 11 such as cement block wall on a peripheral footing 12 buried in the ground beneath the frost line. Also, an access opening 16, shown in FIG. 2, preferably is provided in the foundation wall 11, above ground level, or a hatch door is provided in the roof or ceiling to permit access into the crawlspace when necessary. Any air vents present in the crawlspace walls 11 or foundation optionally may be sealed or covered with the crawlspace liner since air circulation is not important after the crawlspace is sealed.

According to an embodiment of the present invention the relatively level floor 17 of the crawlspace may be provided with a low spot which is open to a sump pit 19 which, depending upon the slope of the terrain, may contain a sump pump and a discharge pipe 20 which extends up and over the foundation and drains to an external location whenever the water level of the sump pit 19 rises to the activation level of the sump pump. Preferably, the sump pit 19 may comprise a sump reservoir containing a conventional lever-activated sump pump. The incorporation of the sump pit or pump is preferred in installations where excessive amounts of water may be drawn up to the dirt or concrete floor 17 of the crawlspace and/or may penetrate the cement block foundation 11, above or below ground level, and enter the crawlspace and accumulate beneath a conventional plastic film barrier layer.

Even in systems in which the floor of the crawlspace is formed of poured concrete, water vapor can penetrate up into the crawlspace at the wall/floor interface or through cracks in the floor, from the dirt soil therebeneath.

The essential element of the present system is a durable molded plastic drainage panel 21 which is an embossed flexible plastic sheet having a thickness of from about 0.03" to about 0.10" (30 mils to 100 mils), preferably about 0.04" to about 0.07", which is embossed with hollow frustroconical protuberances or bosses which project downwardly to form a plurality of spaced legs or, feet 22, the frustrums 23 of which support the drainage panel 21 above the ground or floor 17 by a distance equal to the extent of the protuberances, preferably between about ⅛" and ½". The interconnected flow space 24 between the undersurface of the drainage panel 21 and the supporting surface of the ground 17 and/or walls 11, between the spaced feet or legs 22, provides a space for the accumulation and flow of water and/or water vapor which penetrates up through the ground or through the foundation wall 11 of the crawlspace. Floor 17 of the crawlspace may be provided with a peripheral water drainage trench 13 adjacent the interior wall 11 of the foundation and beneath the drainage panel 21 to collect and drain any water from the water flow space. The peripheral drainage trench 13 may communicate with the sump pit 19.

Figure 2:
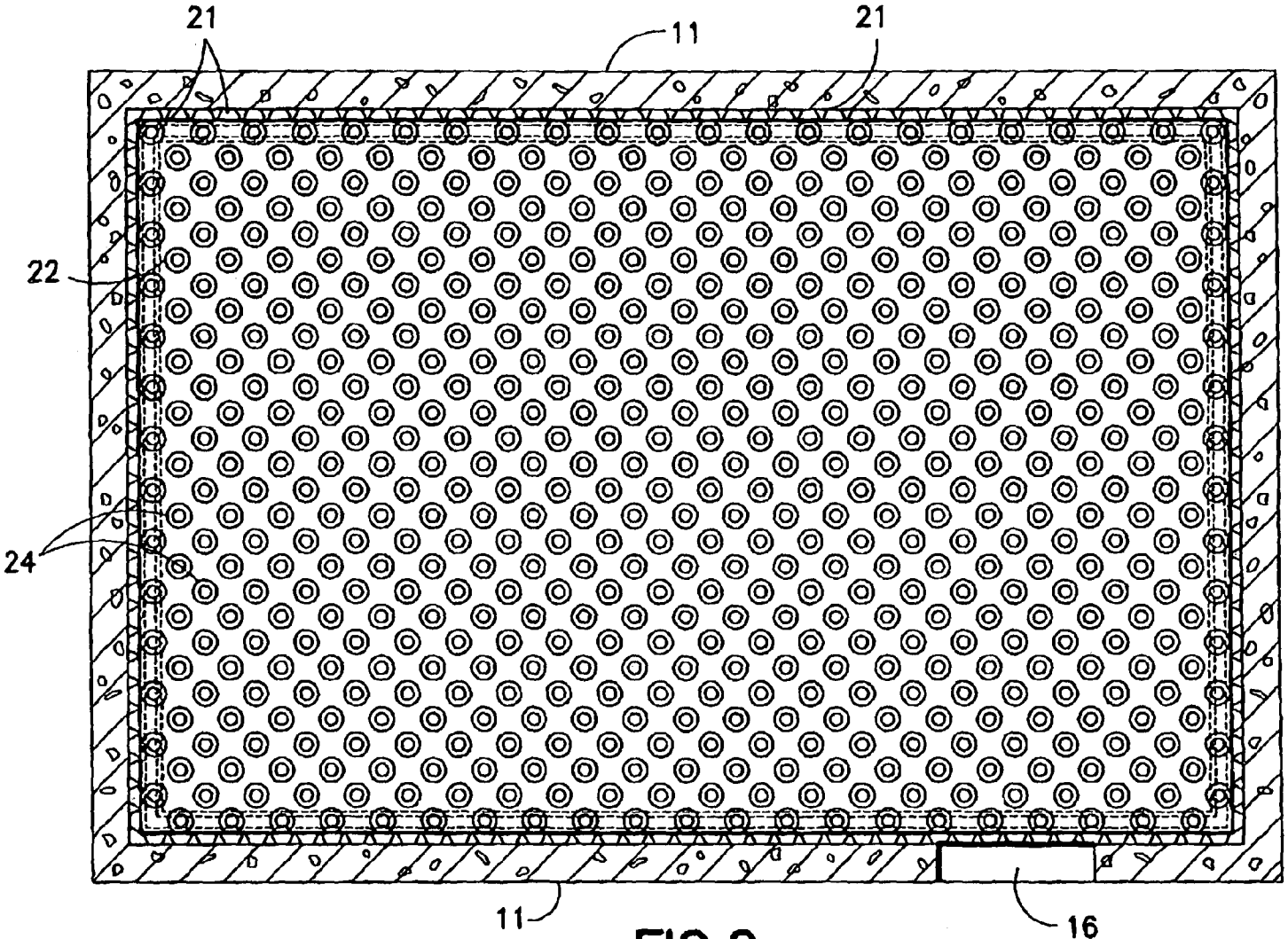
FIG. 2 is a view of the crawlspace, taken along the line 2-2 of FIG. 1.
Figure 3:
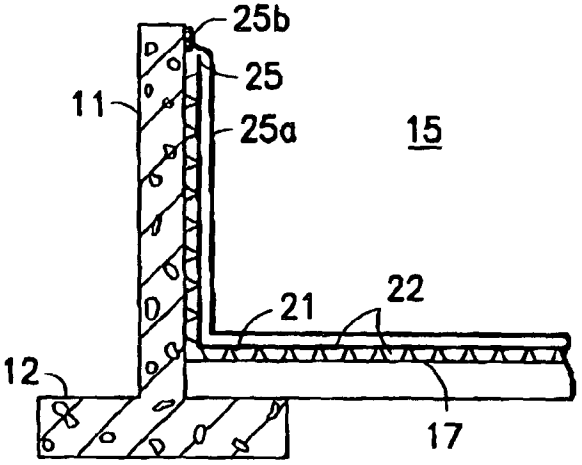

The drainage panel 21 is flexible and therefore can be creased and folded and extended vertically-upward from its horizontal floor-covering position to cover all or a portion of each of the foundation walls 11, as shown in FIGS. 1 and 2. Optionally, the drainage panel 21 can be covered with a sealing liner 25 as shown in FIG. 3. The sealing liner 25 is a continuous sealed crawlspace liner 25, such as of plastic film, which may be a monofilm but preferably is a 16 to 20 mil thick durable heavy duty, fiber-reinforced multi-ply plastic film or rubber sheeting. The crawlspace liner 25 is installed over the drainage panel 21 which extends over the rim of the sump pit 19, if present, and is extended vertically-upwardly over the drainage panel 21 to the tops or close to the tops of the crawlspace walls and sealed against the inner surface of the foundation walls 11 peripherally surrounding and enclosing the crawlspace, as illustrated by the drawings. The upper surface of the liner may be white in color to brighten the crawlspace.

The vertical peripheral crawlspace liner extensions **25*a* are extended and supported against the inner surfaces of the foundation walls 11 and sealed thereto at an elevation which is above the exterior ground level, preferably to the tops or within 3" of the tops of the foundation walls. The continuous marginal liner extensions 25*a* are sealed or bonded to each other and to the entire peripheral inner wall of the foundation 11 adjacent the top thereof by means of an adhesive tape or a continuous bead 25*b* of suitable adhesive or caulk composition such as a polyurethane composition. Preferably, nylon fasteners are used to support the liner 25 vertically over the foundation 11 during installation and prior to caulking. The essential purpose of the crawlspace liner 25 and its extended marginal border areas 25*a* is to prevent the entry of water vapor from the soil or ground into the crawlspace environment and to prevent external ground water or flood water entry into the crawlspace and on top of the crawlspace drainage panel 21, over the dirt floor 17, where it can become trapped and stagnant and can generate mold and fungus and water vapor which can deteriorate and rot structural wood support members of the building 10. The crawlspace liner 25 is sealed adjacent the top of the foundation peripherally, at least adjacent the uppermost edges of the liner extensions, 25*a* by a continuous sealing bead 25*b*, as illustrated. Any exterior ground water which might penetrate the foundation 11, such as through a cement block wall, flows behind and beneath the drainage panel 21, through flow space 24 and down into the low spot of the dirt floor 17 of the crawl space and into the sump pit 19, if present. This keeps the head space 15** of the crawlspace, or the crawlspace environment, dry.

The crawlspace liner 25 may be an integral continuous durable water barrier film or laminate or may be formed of wide strips of such film or laminate, such as six feet in width, which are overlapped and sealed along the edges thereof with the waterproof caulk or adhesive or adhesive tape to provide a continuous sealed barrier liner 25 of the required dimensions over the drainage panel 21. The installed crawlspace liner 25 and drainage panel 21 totally encapsulate the crawlspace environment and completely isolate the building envelope and upper living spaces from the earth therebelow and from the dampness, insects and radon contained therein, to provide a healthier home environment. The liner 25 must be sufficiently durable to resist tearing and piercing under the weight of installers, and is cushioned by the durable embossed drainage panel 21.

Figure 4:
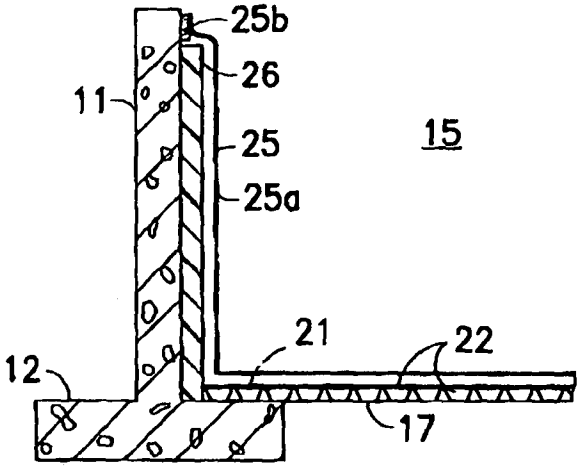
FIGS. 3, 4 and 5 are partial cross-sectional views of a segment of a crawlspace encapsulated according to other embodiments of the present invention.
Figure 5:
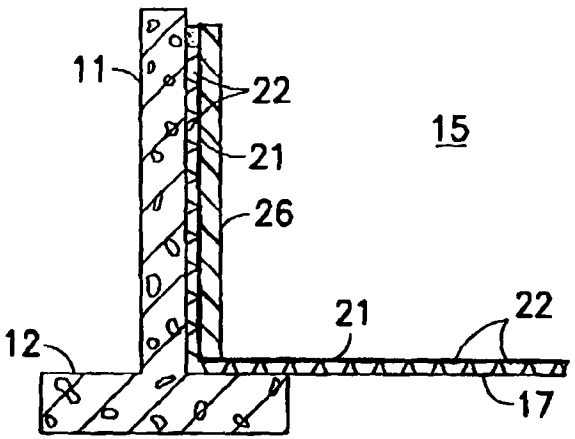

FIGS. 4 and 5 illustrate the optional use of sheets 26 of closed-cell plastic foam such as polyurethane insulation foam which is impervious to water and water-vapor. Such sheets are commercially available in thicknesses of 1", 2" or more. They can be bonded to the interior surfaces of the foundation walls 11, under the liner film 25, as shown in FIG. 4, or they can be applied over the inside surface of a plastic drainage panel 21 having its embossed surface positioned against the interior surfaces of the walls 11, as illustrated by FIG. 5. In FIGS. 4 and 5, the drainage panel 21 is installed horizontally over the surface of the ground 17, which may be of dirt or concrete, with the plurality of closely spaced feet or legs 22 spacing the panel 21 therefrom and providing a flow space 24 under the panel 21 for the drainage of water or water vapor to a sump pit 19 or for absorption back into the ground.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. A water-barrier and drainage system for preventing the penetration of water vapor and ground water into the crawlspace environment of a building, said crawlspace environment having a floor surrounded by a substantially continuous peripheral foundation enclosing said crawlspace environment beneath the building, said system comprising a continuous embossed plastic drainage panel disposed against an upward facing surface of the floor so that the panel covers the upward facing surface of the entire floor of the crawlspace so that the panel defines a continuous barrier surface that prevents penetration of ground water and water vapor there through and prevents penetration of groundwater and water vapor up through the floor and into the air space of the crawlspace, said plastic drainage panel being embossed to provide a plurality of spaced protuberances at the underside thereof forming legs which support the drainage panel spaced from the floor of the crawlspace to provide a water flow space adjacent the floor for the drainage of water and water vapor which penetrates up through the floor of the crawlspace or through the walls of the crawlspace, wherein said drainage panel includes vertical extensions which extend vertically up against the interior peripheral foundation to a height above the floor/foundation interface to provide a continuous barrier against the penetration of exterior groundwater through said foundation and water vapor from said floor and into said crawlspace environment while providing a water flow space between the drainage panel and the foundation and floor for the escape of water and water vapor from beneath the drainage panel.

2. A water barrier and drainage system according to claim 1 in which the foundation wall of the crawlspace is first covered by a plastic foam insulation board, and the edges of the embossed drainage panel covering the floor of the crawlspace are sealed to the insulation board.

3. A water barrier and drainage system according to claim 1 in which the floor of the crawlspace is a concrete floor, and wherein the vertical extensions are embossed providing a further plurality of spaced protuberances facing outward against the interior peripheral foundation spacing the vertical extensions inward from the interior peripheral foundation.

4. A water barrier and drainage system according to claim 1 in which the floor of the crawlspace is a dirt floor provided with a peripheral water drainage trench adjacent the interior wall of the foundation and beneath the drainage panel to collect and drain any water from the water flow space.

5. A water barrier and drainage system according to claim 4 in which the dirt floor of the crawlspace is further provided with a sump pit, with which the peripheral drainage trench communicates, to drain excessive amounts of ground water thereinto from said water flow space.

6. A water barrier and drainage system according to claim 5 in which said sump pit includes a sump pump and a drain conduit for pumping excessive amounts of ground water from the water floor space.

7. A water-barrier and drainage system for preventing the penetration of water vapor and ground water into the crawlspace environment of a building, said crawlspace environment having a floor surrounded by a substantially continuous peripheral foundation enclosing said crawlspace environment beneath the building, said system comprising a continuous embossed plastic drainage panel disposed against an upward facing surface of the floor so that the panel covers the entire upward facing surface of the floor of the crawlspace to provide a barrier against the penetration of groundwater and water vapor up through the floor and into the air space of the crawlspace, said plastic drainage panel being embossed to provide a plurality of spaced protuberances at the underside thereof forming legs which support the drainage panel spaced from the floor of the crawlspace to provide a water flow space adjacent the floor for the drainage of water and water vapor which penetrates up through the floor of the crawlspace or through the walls of the crawlspace, the water barrier and drainage system comprising an encapsulating system including a continuous sealed plastic liner barrier layer covering the entire drainage panel to provide a barrier against the penetration of groundwater and water vapor through the floor and foundation and into the air space of the crawlspace, said barrier layer having vertical extensions which extend vertically up against the interior peripheral foundation to a height greater than the corresponding ground level at the exterior surface of the foundation and which are bonded to the interior peripheral foundation by a continuous seal adjacent the upper edges of said extensions to provide a continuous barrier against the penetration of exterior groundwater and water vapor through said foundation into said crawlspace environment, wherein said drainage panel includes vertical extensions which extend vertically up against the interior peripheral foundation to a height above the floor/foundation interface to provide a continuous barrier against the penetration of exterior groundwater through said foundation and water vapor from said floor and into said crawlspace environment while providing a water flow space between the drainage panel and the foundation and floor for the escape of water and water vapor from beneath the drainage panel.

8. An water barrier and drainage system according to claim 7 in which said plastic liner barrier layer is a multi-ply, fiber-reinforced, durable plastic film laminate.

9. A water barrier and drainage system according to claim 7 in which the water barrier liner is formed from two or more wide strips of barrier layer material having their edges overlapped and united by a continuous seal.

10. A water barrier and drainage system according to claim 7 in which the vertical extensions of the plastic liner barrier layer extend to a height adjacent the top of the interior peripheral foundation and are bonded thereto adjacent the top thereof, and wherein the vertical extensions are embossed providing a further plurality of spaced protuberances facing outward against the interior peripheral foundation spacing the vertical extensions inward from the interior peripheral foundation.

11. A water barrier and drainage system according to claim 7 in which the floor of said crawlspace is a concrete floor.

12. A water-barrier and drainage system for preventing the penetration of water vapor and ground water into the crawlspace environment of a building, said crawlspace environment having a floor surrounded by a substantially continuous peripheral foundation enclosing said crawlspace environment beneath the building, said system comprising a continuous embossed plastic drainage panel disposed against an upward facing surface of the floor so that the panel covers the entire upward facing surface of the floor of the crawlspace to provide a barrier against the penetration of groundwater and water vapor up through the floor and into the air space of the crawlspace, said plastic drainage panel being embossed to provide a plurality of spaced protuberances at the underside thereof forming legs which support the drainage panel spaced from the floor of the crawlspace to provide a water flow space adjacent the floor for the drainage of water and water vapor which penetrates up through the floor of the crawlspace or through the walls of the crawlspace, in which said drainage panel includes vertical extensions which extend vertically up against the interior peripheral foundation to a height above the floor/foundation interface to provide a continuous barrier against the penetration of exterior groundwater through said foundation and water vapor from said floor and into said crawlspace environment while providing a water flow space between the drainage panel and the foundation and floor for the escape of water and water vapor from beneath the drainage panel, in which the surfaces of the vertical extensions of the drainage panel, opposite the surfaces against the foundation are covered by a plastic foam insulation board.

13. A water-barrier and drainage system for preventing the penetration of water vapor and ground water into the crawlspace environment of a building, said crawlspace environment having a floor surrounded by a substantially continuous peripheral foundation enclosing said crawlspace environment beneath the building, said system comprising a continuous embossed plastic drainage panel disposed against an upward facing surface of the floor so that the panel covers the entire upward facing surface of the floor of the crawlspace to provide a barrier against the penetration of groundwater and water vapor up through the floor and into the air space of the crawlspace, said plastic drainage panel being embossed to provide a plurality of spaced protuberances at the underside thereof forming legs which support the drainage panel spaced from the floor of the crawlspace to provide a water flow space adjacent the floor for the drainage of water and water vapor which penetrates up through the floor of the crawlspace or through the walls of the crawlspace, in which the foundation wall of the crawlspace is first covered by a plastic foam insulation board, and the edges of the embossed drainage panel covering the floor of the crawlspace are sealed to the insulation board, the water barrier and drainage system further comprising a durable plastic liner barrier layer over the embossed drainage panel on the floor and up over the plastic foam insulation board on the wall of the crawlspace, wherein said drainage panel includes vertical extensions which extend vertically up against the interior peripheral foundation to a height above the floor/foundation interface to provide a continuous barrier against the penetration of exterior groundwater through said foundation and, water vapor from said floor and into said crawlspace environment while providing a water flow space between the drainage panel and the foundation and floor for the escape of water and water vapor from beneath the drainage panel.

14. A water barrier and drainage system according to claim 13 in which the plastic foam insulation board and the embossed drainage panel cover the entire surface of the foundation wall of the crawlspace, up to the top thereof, and the plastic liner barrier layer extends up over the embossed drainage panel and is sealed to the upper edge thereof to encapsulate the crawlspace, and wherein the vertical extensions are embossed providing a further plurality of spaced protuberances facing outward against the interior peripheral foundation spacing the vertical extensions inward from the interior peripheral foundation.

* * * * *